United States Patent [19]

Lin

[11] Patent Number: 4,830,257

[45] Date of Patent: May 16, 1989

[54] ELECTROPNEUMATIC V-STAPLE DRIVING MACHINE

[76] Inventor: Long-Chung Lin, No. 132-54, Sung-Jeau Village, Kuan Miao Hsiung, Tainan Hsien, Taiwan

[21] Appl. No.: 231,772

[22] Filed: Aug. 12, 1988

[51] Int. Cl.[4] ..... B25C 5/02; B25C 7/00

[52] U.S. Cl. ..... 227/152; 227/156

[58] Field of Search ..... 227/30, 148, 152, 154, 227/156

[56] References Cited

U.S. PATENT DOCUMENTS

| | | | |
|---|---|---|---|
| 199,579 | 1/1878 | Rose | 227/148 |
| 978,187 | 12/1919 | Miller | 227/148 X |
| 2,183,789 | 12/1939 | De Rosha et al. | 227/152 |
| 2,900,638 | 8/1959 | O'Kelley | 227/154 X |
| 2,903,699 | 9/1959 | Mazzola | 227/152 X |
| 3,112,105 | 11/1963 | Keller | 227/152 X |
| 4,126,259 | 11/1978 | Galer et al. | 227/148 X |
| 4,127,226 | 11/1978 | Jasper | 227/148 X |
| 4,436,234 | 3/1984 | Kennedy | 227/30 X |
| 4,572,420 | 2/1986 | Pistorius | 227/152 X |

*Primary Examiner*—Paul A. Bell

*Attorney, Agent, or Firm*—Michael N. Meller

[57] ABSTRACT

An electropneumatic V-staple driving machine includes: a machine stand with a switching device on the upper side; a first pressure cylinder member matched with a linking-up mechanism disposed on top of the machine stand; a double positioning seat and a first support frame installed over the first pressure cylinder member; a pair of staple setting devices provided on top of the double positioning seat and operatively connected with the linking-up mechanism for arranging the V-staples therein; a pair of percussion members fixed on top of the linking-up mechanism in conjunction with the staple setting devices for punching the arranged V-staples into a wooden surface of a workpiece; a working table vertically mounted on top of the machine stand over the staple setting devices for holding a workpiece thereon; a pressure feed mechanism installed on a side wall of the working table and connected between the switching device and the first pressure cylinder mechanism; and a second cylinder member matched with a second support frame installed on top of the working table and connected to the switching device for holding a workpiece in position; thereby, two V-staples can be simultaneously driven into a wooden surface of a workpiece.

3 Claims, 11 Drawing Sheets

ELECTROPNEUMATIC V-STAPLE DRIVING MACHINE

BACKGROUND OF THE INVENTION

This invention relates to an electropneumatic V-staple driving machine by which a pair of V-staples can be simultaneously driven into a wooden surface for binding the corner joints of a workpiece.

Conventionally, staples are driven into a wooden surface for binding the corner joints of a workpiece, such as a picture frame shown in FIG. 1, by a staple driving gun or a stapler, both of which are manually operated to press the staples singlarly into the wooden joint. The work performed by the known staple driving devices is a delicate operation and requires a very careful worker to drive the staples into the right spots and present the most aesthetic appearance. In addition, since the known staple driving devices are manually operated and only capable of driving the staples one at a time, each staple driven into the wooden surface of a workpiece may not be uniformly punched so as to stand at the same depth in the wooden surface of a workpiece. Therefore, final finishing work has to be manually done by a staple-driving-gun operator in order to make all the punched staples evenly present on the workpiece, resulting in not only a waste of time, but also a waste of money.

SUMMARY OF INVENTION

It is accordingly a primary object of the present invention to provide an electropneumatic V-staple driving machine that overcomes the foregoing problems associated with the prior art.

It is another object of the present invention to provide an electropneumatic V-staple driving machine with a pair of staple setting means disposed in opposite directions so as to be able to repeatedly perform staple driving operations as well as to simultaneously drive two V-staples into a wooden surface along the corner joints of a workpiece.

It is a further object of the present invention to provide an electropneumatic V-staple driving machine wherein the two staple setting means can be optionally adjusted to suit the different sizes of V-staples and spacing distances at which the V-staples are to be punched into the wooden surface of a workpiece.

These and other objects of the present invention are achieved by providing an electropneumatic V-staple driving machine which comprises: a machine stand; a first pressure cylinder member matched with a linking-up mechanism disposed on top of the machine stand; a first support frame mounted on top of the machine stand for supporting the first pressure cylinder member and the linking-up mechanism; a switching device electrically installed on an upper side of the machine stand; a double positioning seat with a plurality of adjusting means provided on top of the first support frame for adjusting the staple driving positions; a pair of staple setting devices opposingly installed on the double positioning seat and operatively connected with the linking-up mechanism for positioning the V-staples on a stand-by location; a pair of L-shaped percussion members having the lower ends parallelly installed on top of the linking-up mechanism and the upper portions movably received in a adapter block connected to the front end of each staple setting device for punching the stand-by V-staple into a wooden surface of a workpiece in conjunction with the movement of first pressure cylinder member; a working table vertically mounted on top of the machine stand over the staple setting devices with a pair of positioning members separately disposed on top of the working table for keeping a workpiece thereon during staple driving operations; a pressure feed mechanism functionally connected between the switching device and the firs pressure cylinder member through an operating switch; and a second support frame having a second pressure cylinder member functionally connected to the pressure feed mechanism and operatively installed in a second support frame being mounted on top of the working table for holding a workpiece on said table during the performance of staple driving operations; thereby, two V-staples can be simultaneously driven into a wooden surface for binding the corner joints of a workpiece, and such staple driving operations can be repeatedly performed through the switching device and the operating switch.

BRIEF DESCRIPTION OF THE DRAWINGS

Other advantages and characteristics of the present invention will become apparent from the following detailed description of a preferred embodiment of an electropneumatic V-staple driving machine when read in conjunction with the accompanying drawings in which.

DETAILED DESCRIPTION OF THE PREFERRED EMBODIMENT

Figure 3:
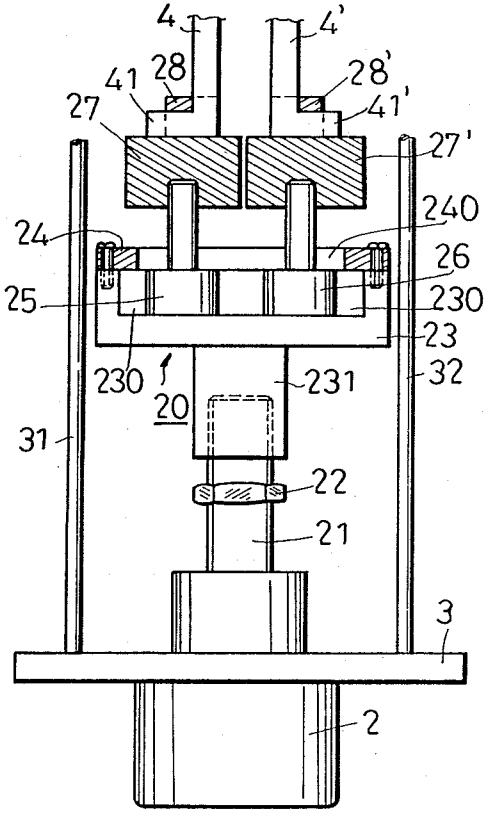
FIG. 3 is a partial sectional view of a first pressure cylinder mechanism and the associated elements provided in the preferred embodiment.
Figure 1:
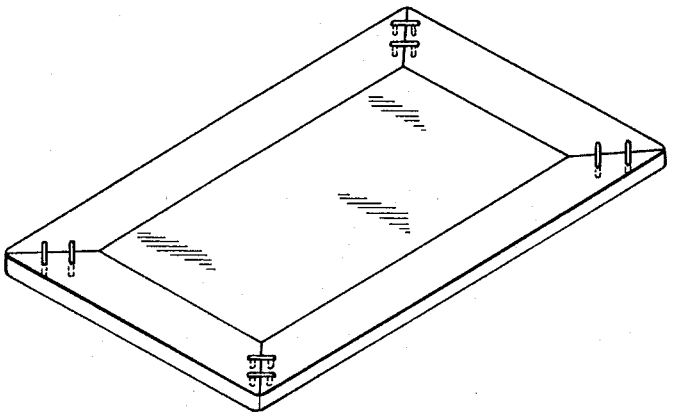
FIG. 1 (PRIOR ART)
FIG. 1 is an illustration of staples driven into a wooden surface for binding the corner joints of a picture frame by a known staple driving device.
Figure 2:
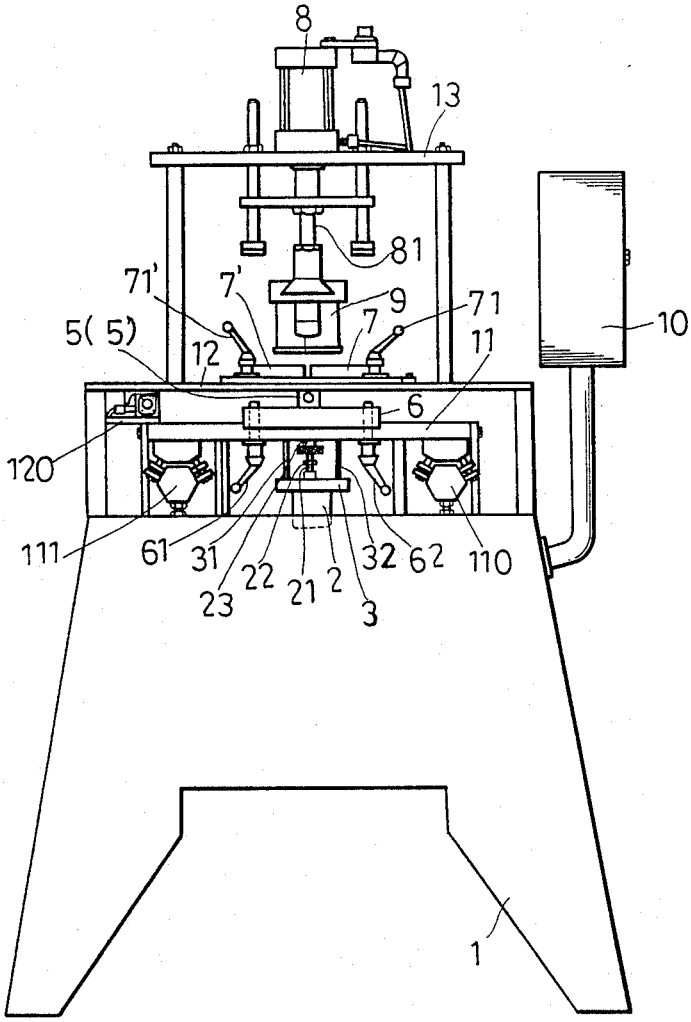
FIG. 2 is a front elevational view of a preferred embodiment of an electropneumatic V-staple driving machine according to the present invention.
Figure 4:
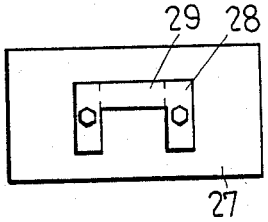
FIG. 4 is a top view of a combined check block and a baffle plate arranged in the preferred embodiment.

Referring to FIGS. 2, 3 and 4, the preferred embodiment of an electropneumatic V-staple driving machine according to this invention comprises: a machine stand 1; a first pressure cylinder member 2 installed on top of the machine stand 1 with a first cylinder shaft 21 extending upward through a cyliner frame 3 mounted on top of the first cylinder member 2; an adjusting nut 22 adjustably disposed around alower portion of the first cylinder shaft 21; a linking-up mechanism 20 disposed on top of the first cylinder shaft 21; a switching device 10 mounted on an upper side of the machine stand 1 for being operated to select the desired operational mode (singular motion or link-up motion); a first support frame 11, having a pair of sliding members 110, 111 installed on a bottom side, vertically mounted on top of the machine stand 1 over the upper portion of the linking-up mechanism 20 with a pair of bearing struts 31, 32 separately connected between the bottom side of the first support frame 11 and the top side of the cylinder frame 3; a double positioning seat 6 having a first and a second adjusting handles 61, 62 separately connected to the respective sliding members 110 and 111, adjustably installed on a top side of the first support frame 11; a front and a rear staple setting devices 5 and 5' opposingly secured on top of the double positioning seat 6; a working table 12 provided over the front and rear staple setting devices 5, 5' and fixed upright on the top surface of the machine stand 1; a pressure feed mechanism 120 fixed on an internal side wall of the working table 12 and functionally connected between the switching device 10 and the first pressure cylinder member 2 through an operating switch (not shown); a pair of positioning members 7 and 7' each being matched with a third and a fourth adjusting handle 71, 71' movably installed on top of the working table 12; a second support frame 13 fixed on top of the working table 12 over the positioning members 7, 7'; a second pressure cylinder member 8 matched with a second cylinder shaft 81 operatively installed in the second support frame 13 and functionally connected to the pressure feed mechanism 120; and a rubber pressing member 9 screwed to a lower end of the second cylinder shaft 81.

As shown in FIGS. 3 and 4, the linking-up mechanism 20 includes: a head support 23, having an open section 230 formed in an upper portion and a hexagonal threaded cylindrical part 231 vertically located at the lower end, screwed to the upper end of the first pressure cylinder shaft 21 over an adjusting nut 22 disposed around the first cylinder shaft 21 below the hexagonal threaded cylindrical part 231; a stay plate 24 with a locating slot 240 fixed on top of the head support 23; and a pair of adjusting screw bolts 25, 26 symmetrically disposed in the open section 230 with each upper portion of both screw bolts 25, 26 vertically extending out of the locating slot 240 for being displaced from left to right therein; a pair of baffle plates 27, 27' separately screwed to the upper portions of both screw bolts 25, 26; and a pair of U-shaped check blocks 28, 28', each having a channel 29, 29' formed in the bottom center, screwed to the baffle plates 27, 27'. As can be seen in FIG. 3, a first and a second L-shaped percussion members 4, 4' are separately fixed on top of each baffle plate 27, 27' and the horizontal portion 41' of each percussion member 4, 4' is inserted in the respective channels 29, 29' of the check blocks 28, 28' and positioned thereat.

Figure 5:
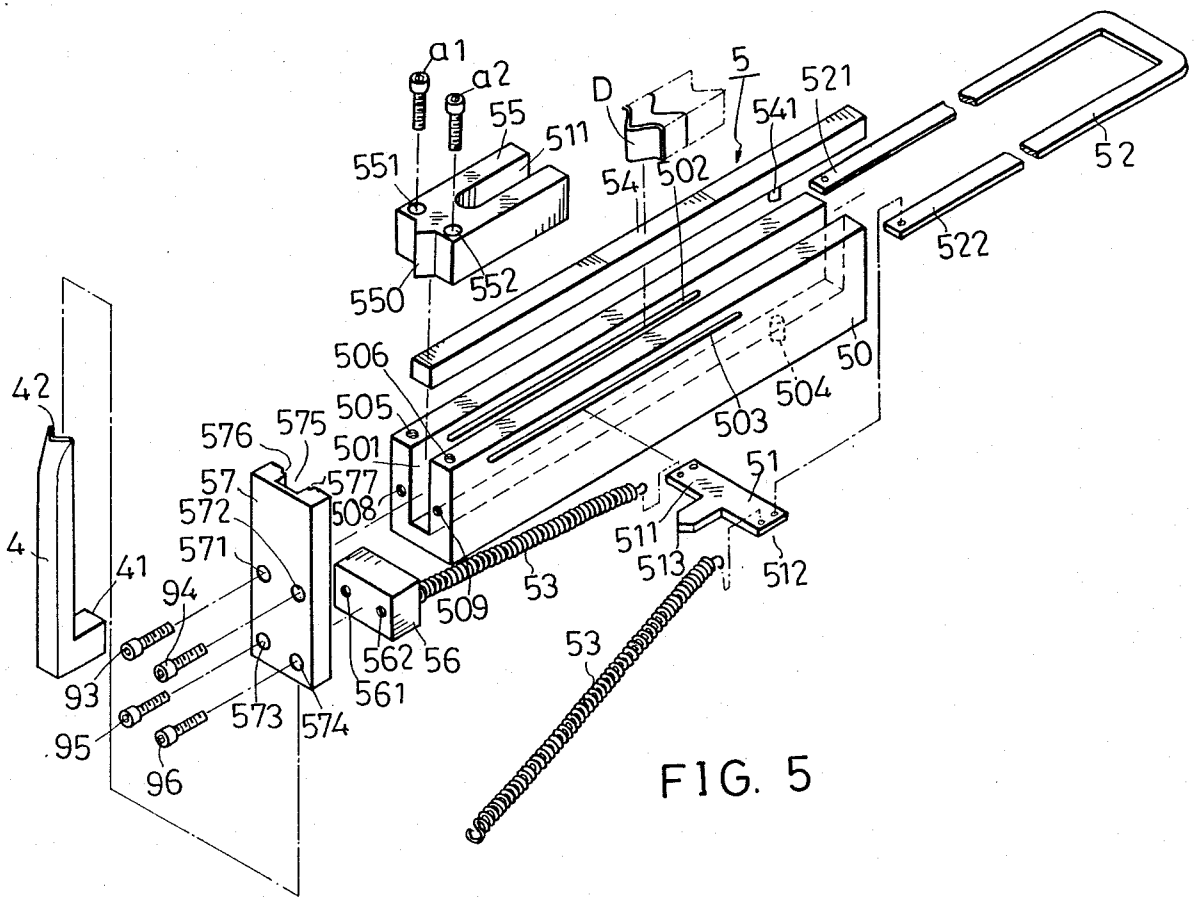
FIG. 5 is an exploded and perspective view of a front staple setting device disposed in the preferred embodiment.
Figure 6:
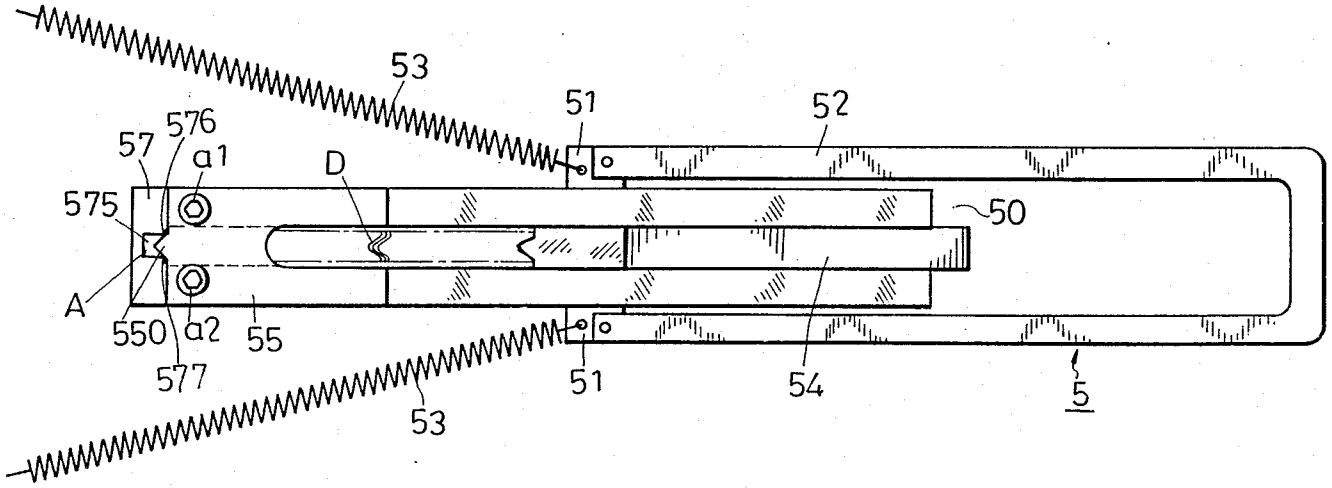
FIG. 6 is a top elevational view of the assembled front staple setting device shown in FIG. 5.
Figure 7:
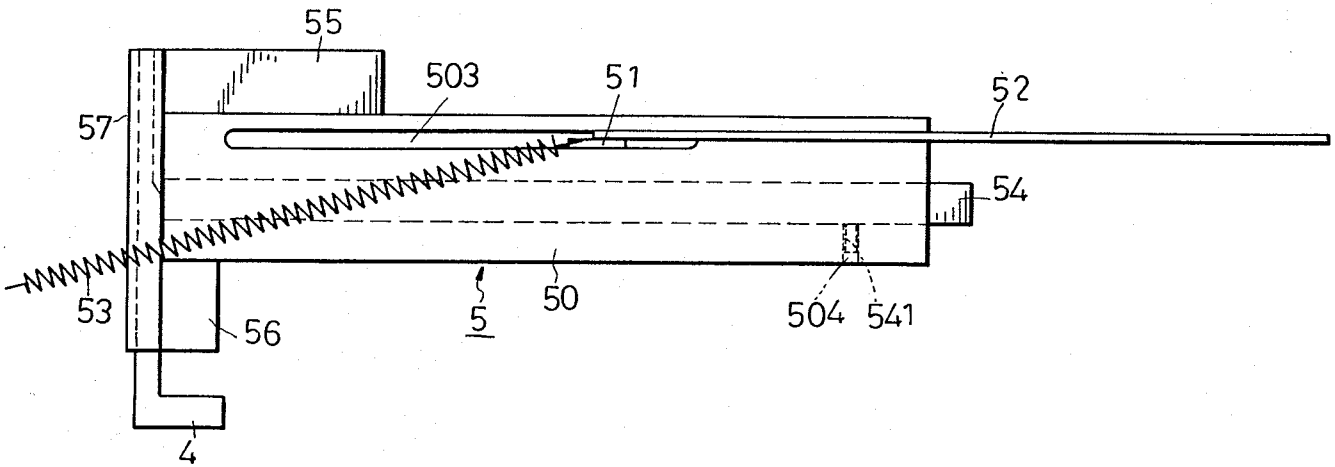
FIG. 7 is a side elevational view of the assembled front staple setting device shown in FIG. 5.

Referring to FIGS. 5, 6 and 7, the front staple setting device 5 includes: a staple seat 50 having an open trough 501 horizontally formed through the middle portion, an orifice 504 in the bottom side, and a pair of sliding slots 502, 503 parallelly provided in the opposing side walls along the upper portion of the staple seat 50; a T-shaped driven piece 51 having two opposing sides 511, 512 movably installed in the sliding slots 502, 503 and a front angular end 513 horizontally extending forward in the open section 501 of the staple seat 50; an open drag frame 52, having two front side ends 521, 522 fastened to the opposing sides 511, 512 of the T-shaped driven piece 51, movably disposed along the outer upper portion of the staple seat 50 (as shown in FIG. 6); a pair of drag springs 53 one end of each being separately fixed at the opposing sides 511, 512 of the driven piece 51 and the other end of each being attached to the double positioning seat 6 (as shown in FIG. 2) for the purpose of continuously dragging the driven piece forward to the front end of the staple seat 50; an elongated joist 54 having a stub end 541 extending from the bottom side thereof, movably disposed on the bottom side wihin the open trough 501 of the staple seat 50 with the stub end 541 being adjustably inserted into the orifice 504 so as to be moved up and down in a height adjustment made in conjunction with the different sizes of the V-staples D to be placed (in a strip) in the open trough 501 over the elongated joist 54; an upper mold member 55 with a V-shaped protrution 550 at the front end and a U-shaped opening 551 at the rear portion thereof connected to the front end of the staple seat 50 through the screws 91, 92 and the screw holes 551, 552 of the mold member 55 and the screw holes 505, 506 of the staple seat 50; a lower mold member 56 for being attached to the front bottom side of the staple seat 50; an adapter block 57, having an elongated U-shaped opening 575 vertically formed in the back side, a pair of V-shaped grooves 576 and 577 separately located in parallel with the elongated U-shaped opening 575, and a plurality of screw holes 571, 572, 573 and 574, connected with both the front end of the staple seat 50 through the screw holes 508, 509, 571, 572 with the screws 93, 94 and the lower mold member 56 through the screw holes 561, 562, 573, 574 with the screws 93, 94, as shown in FIG. 7. The assembled front staple setting device 5 is as shown in FIG. 6 wherein the V-shaped protrusion 500 of the upper mold member 55 is disposed on the front end of the staple seat 50 and extends into the U-shaped opening 575 of the adapter block 57, resulting in defining a V-shaped channel A in the U-shaped opening 575 where the V-shaped vertical portion 42 of the first L-shaped percussion member 4 is movably located so as to push the front end of the V-staple D into the V-shaped channel A by the driven piece 51, and finally punch a first piece of the V-staple D into a wooden surface on a back-side corner joint of a workpiece.

Figure 8:
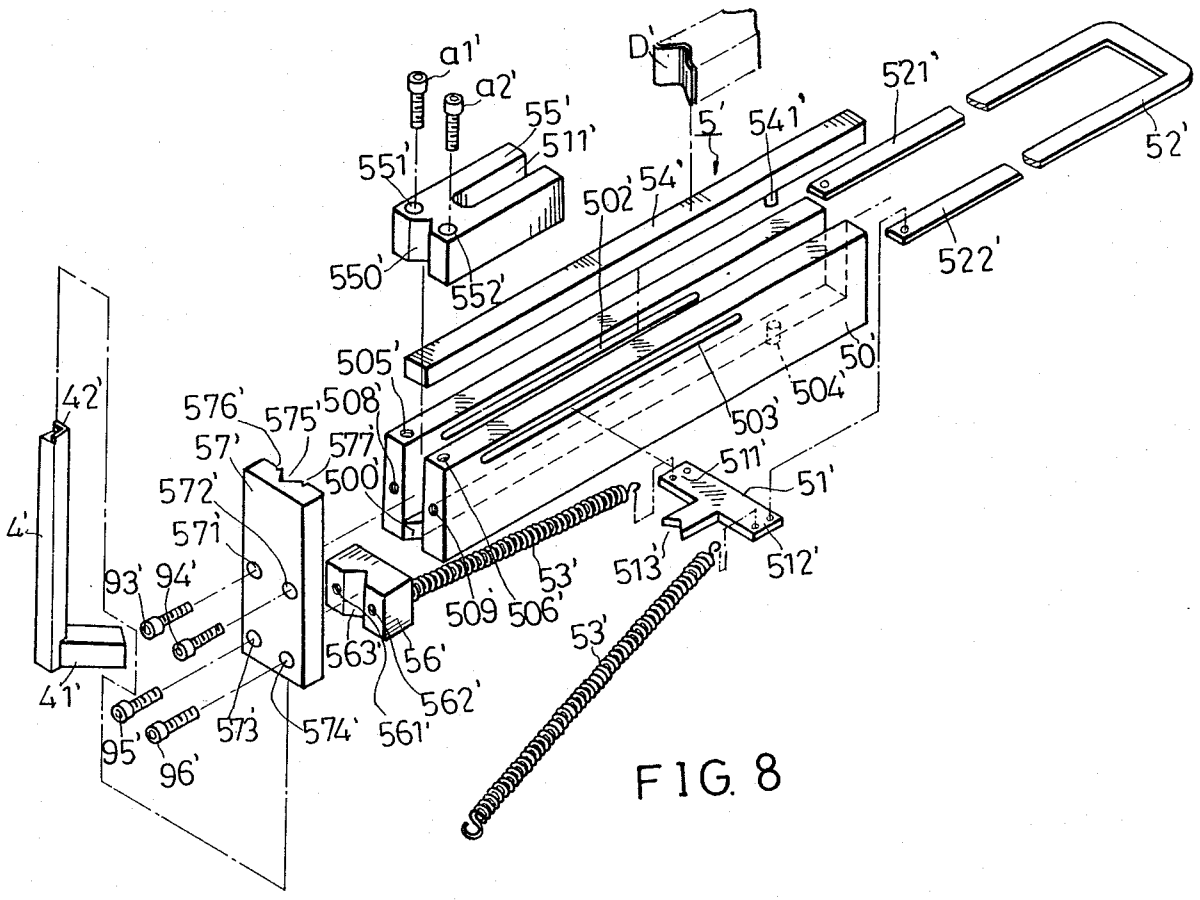
FIG. 8 is an exploded and perspective view of a rear staple setting device disposed in the preferred embodiment.
Figure 9:
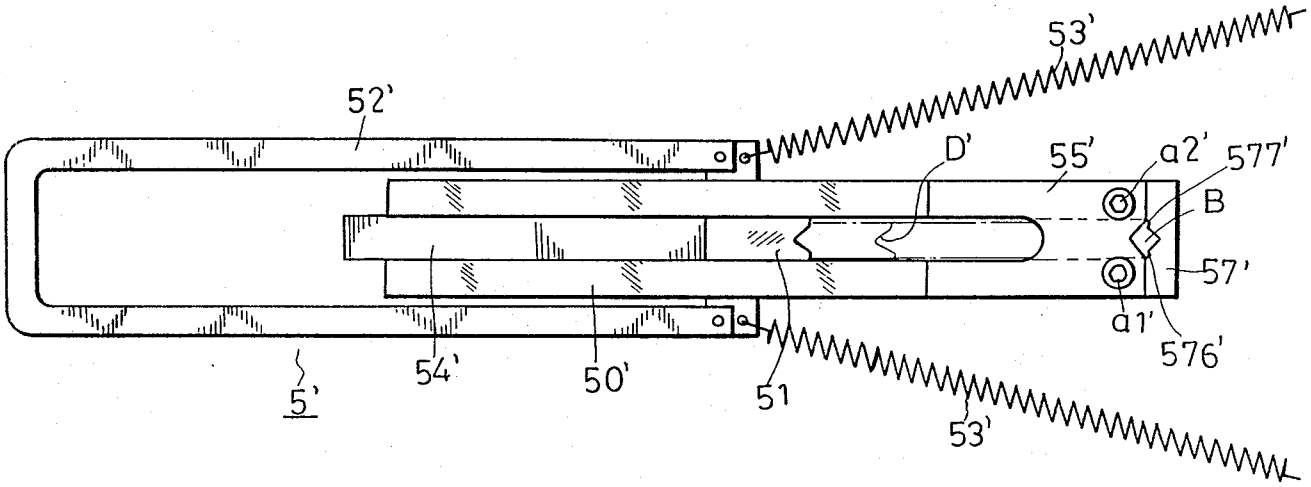
FIG. 9 is a top elevational view of the assembled rear staple setting device shown in FIG. 8.
Figure 10:
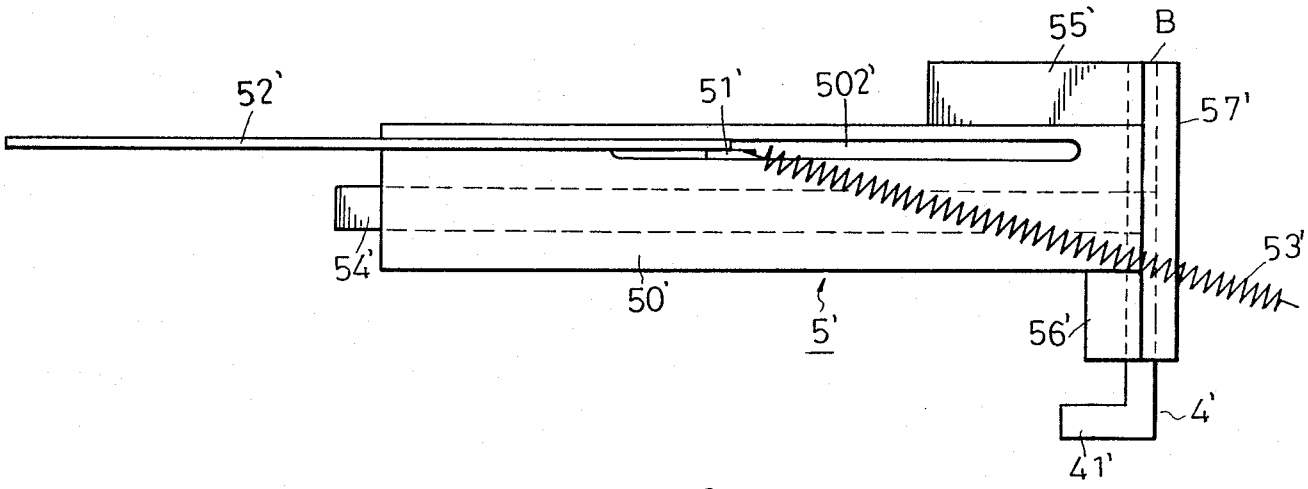
FIG. 10 is a side elevational view of the assembled rear staple setting device shown in FIG. 8.

Referring to FIGS. 8, 9, and 10, and example of the rear staple setting device 5' of which the structure is the same as that of the front staple setting device 5 is shown. Therefore, all members or elements identical with or corresponding to those illustrated in FIGS. 5, 6 and 7 are indicated by the same reference numerals except that a prime (') is added to each numeral for distinquishing purposes. As can be seen in FIG. 8, the main difference between the front staple setting device 5 and the rear staple setting device 5' is that a V-shaped recess 513' in the front end of the driven piece 51', a V-shaped notch 550', 563 in the front side of the upper mold member 55' and the lower die member 56', and an elongated V-shaped opening 575' in the back side of the adapter block 57', are respectively provided for being combined to define a rhombus-shaped channel B, as shown in FIG. 9, and for movably accommodated the rhombus-shaped vertical portion 42' of the second L-shaped percussion member 5' therein.

Figure 11:
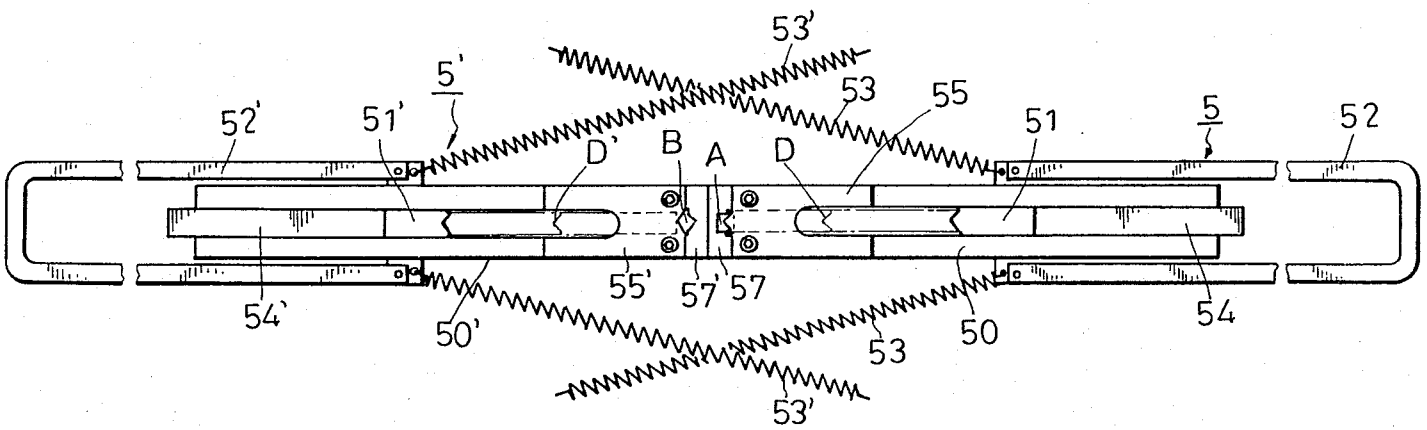
FIG. 11 is a top elevational view of the combined front and rear staple setting devices respectively shown in FIGS. 5 and 8.
Figure 12:
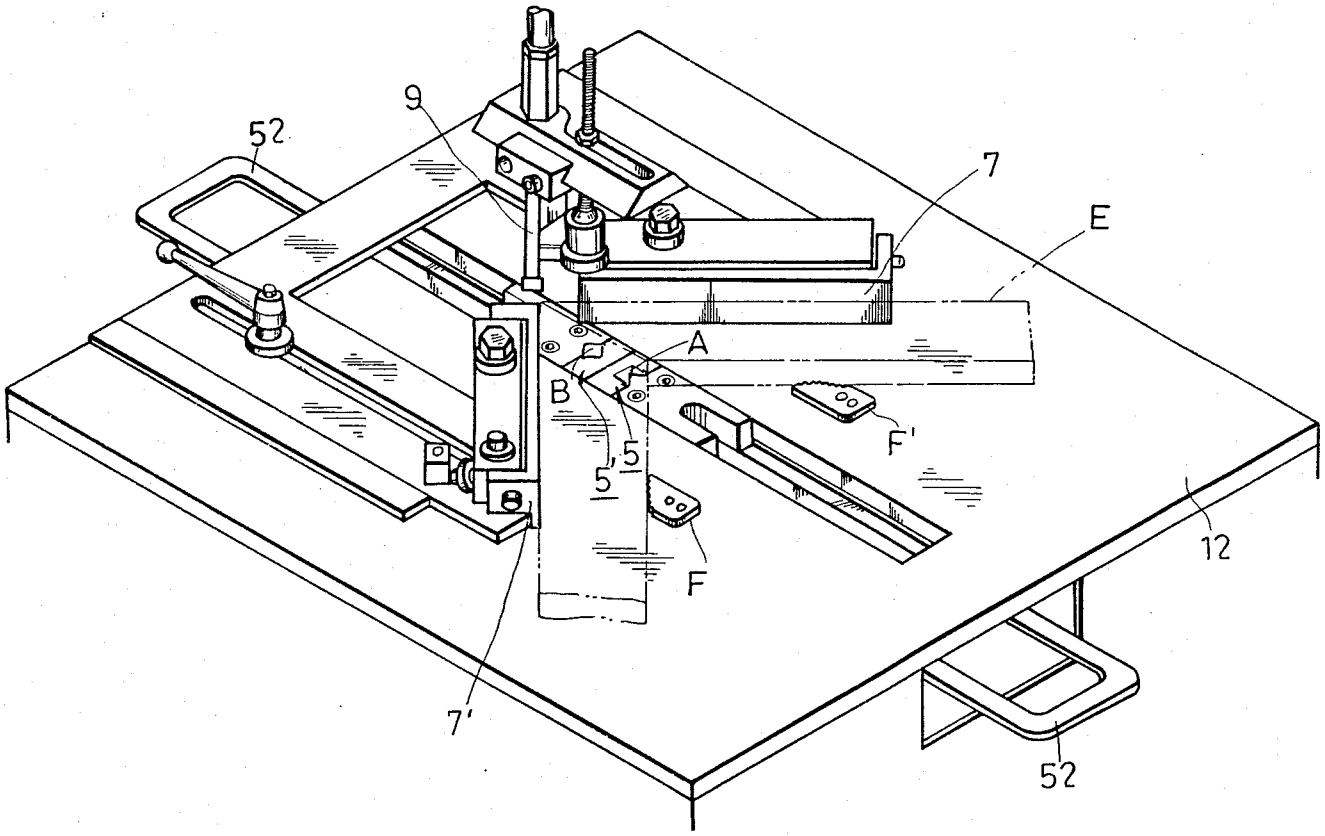
FIG. 12 is a perspective view of a working table under which the combined front and rear staple setting devices are arranged for performing V-staple driving operations on a workpiece.
Figure 13:
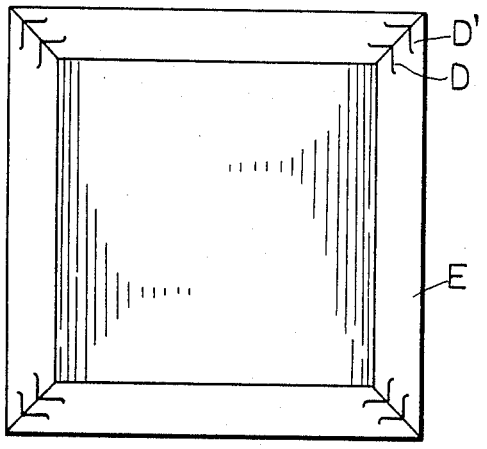
FIG. 13 is an illustration of the V-staples driven into a wooden surface of a workpiece by the preferred embodiment shown in FIG. 2.

Referring to FIGS. 11, 12 and 13, the front and rear staple setting devices 5 and 5', are opposingly disposed under the second support table 12, as respectively shown in FIGS. 11 and 12, and supported by the double positioning seat 6 (as shown in FIG. 2). During staple driving operation, the user pulls both drag frames 52, 52' of the front and rear staple setting devices 5, 5' backward in opposite directions for respectively placing the V-staples D, D' on both joists 54, 54' in the open troughs 501, 501' of both staple seats 50, 50' in opposite directions (i.e. the front end of the V-staple D is directed toward the channel A of the front staple setting device 5 while the rear end of the staple D' is directed toward the channel B of the rear staple setting device 5'), and then, by releasing the drag frames 52, 52', the driven pieces 51 and 51' will respectively push the V-staple D, D' from the open troughs 501, 501' toward the respective front ends of both front and rear staple seats 50, 50' until the first piece of the V-staple D and the last piece of the staple D' are respectively located in the respective channels A and B, ready to be punched therefrom by the respective L-shaped percussion members 4, 4'. If the V-staples D and D' are of a smaller size (it shall be appreciated that only the lenghth of the staples is variable, and the width thereof is all the same), the user can adjust the height of the joist 54, 54' located in the open trough 501, 501' of the staple seat 50, 50' so that it matches the level of the driven pieces 51, 51' slidingly located in the respective die seats 50, 50'. After the adjustment is made and an operational mode is selected from the switching device 10, positioning a workpiece E on the working table 12 through the positioning members 7, 7', and turning on a power switch (not shown) in the switching device 10, the positioning pieces F and F' of the positioning members 7, 7' will be moved backward so as to hold tightly the workpiece E within the positioning members 7, 7', as shown in FIG. 12. In the meantime, the second pressure cylinder member 8 will be operated to drive the rubber pressing member 9 downward and tightly press it to the top of the workpiece E. Finally, by pressing the operating switch (not shown), the first pressure cylinder member 2 will be activated to move frist cylinder shaft 21 (as shown in FIGS. 2 and 3) upward so as to push up the head support 23 of the linking-up mechanism 20 therefrom, together with a screw bolts 25, 26, the baffle plates 27, 27', and the U-shaped check blocks 28, 28'. As a result, the L-shaped percussion members 4, 4' are instantaneously thrusted up to punch the respective V-staples D, D' separately located in both channels A and B;, into the wooden surface on a back side corner joint of the workpiece E, as shown in FIG. 13. After the two V-staples D, D' are punched into the workpiece E, the first pressure cylinder member 2 will be moved backward, driving the first cylinder shaft 21 downward and together with the downward movement of the head seat 23, the adjustable screw bolts 25, 26, the baffle plates 27, 27', and the check blocks 28, 28', the L-shaped percussion members 4, 4' will be moved down to the original stand-by positions in the U-shaped and rhombus-shaped channels A and B of the staple setting devices 5, 5'. By turning off the power switch from the switching device 10, the positioning members 7, 7', together with the rubber pressing member 9, will be released from the workpiece E along with the upward movement of the second pressure cylinder 8 so as to enable the user to change the working place of the workpiece E and repeat the staple driving operation as described above. In this way the staple driving operations can be repeatedly performed as required with two V-staples being simultaneously punched into position every time without requiring manual finishing operation.

On the other hand, if the workpiece E is of a large size and the driving distance between the V-staples D, D' has to be increased to strengthen the binding effect, the first and second adjusting handles 61, 62 must be turned downward (as shown in FIG. 2) so as to loosen the contact between the double positioning seat 6 and the front and rear staple setting devices 5, 5', and the adjustable screw bolts 25, 26 turned (as shown in FIG. 3) so as to move them apart, outwardly, in the head support 23 for setting the desired distance between the two L-shaped percussion members 4, 4', followed by moving apart the two staple setting devices 5, 5' until a desired distance between the two channels A and B is reached, and then turning the first and second adjusting handles 61, 62 as well as the adjustable screw bolts 25, 26 so as to fasten them at the right location. In this way, the two V-staples D, D' can be punched (as described hereinbefore) into the workpiece E at a desired interval.

It shall be appreciated that, since the two staple setting devices 5, 5' are disposed in opposite directions, the two V-staples D, D' are punched into the workpiece E, as shown in FIG. 13, in the same direction so as to increase the binding effect and aesthetic appearance of the staples.

With the preferred embodiment as illustrated and described, it should be apparent that many changes may be made in the general construction and arrangement of the present invention without departing from the spirit and scope thereof, and it is therefore desired that the present invention not be limited to the exact disclosure but only to the extent of the appended claims.

What is claimed is:

1. An electropneumatic V-staple driving machine comprising:

a machine stand;

a switching device installed on an upper side of said machine stand for effecting power supply and operational mode selections therewith;

a first pressure cylinder mechanism, having a first cylinder shaft disposed on a cylinder frame, mounted on a top surface of said machine stand for being operated to move said first cylinder shaft up and down therefrom;

an adjusting nut screwed to a lower portion of said first cylinder shaft for making an adjustment thereith along said cylinder shaft;

a linking-up means adjustably screwed to an upper portion of said first cylinder shaft over said adjusting nut for being moved up and down along with said first cylinder shaft;

a pair of L-shaped percussion members with each horizontal portion fixed on top of said linking-up mechanism for being moved up and down along with the movement of said first pressure cylinder mechanism during staple driving operations;

a double positioning seat matched with a first support frame being mounted on top of said machine stand and situated over said linking-up mechanism, and having a first and a second adjusting handles installed on a lower portion of said double positioning seat through said first support frame for making positional adjustment therewith;

a pair of staple setting means opposingly secured on top of said double positioning seat through said first and second adjusting handles for respectively arranging a strip of V-staples therein to perform staple driving operations in conjunction with the movement of said first pressure cylinder mechanism;

a working table, having a pair of positioning members adjustably disposed thereon through a third and a fourth adjusting handles, provided over said front and rear staple setting devices and fixed upright on top of said machine stand for holding a workpiece between said positioning dies during staple driving operations;

a pressure feed mechanism fixedly installed on an internal wall of said working table and functionally connected between said switching device and said first pressure cylinder mechanism through an operating switch for being activated to supply pneumatic pressure therefrom; and a second cylinder mechanism installed in a second support frame mounted on a top side of said working table and electrically connected to said switching device for keeping a workpiece in position during staple driving operations; whereby, two V-staples symmetrically arranged in said front and rear staple setting devices can be simultaneously punched into a wooden surface of a workpiece so as to bind the coner joints thereof.

2. The V-staple driving machine according to claim 1 wherein said linking-up mechanism further comprises:

a head support, having an open section formed in an upper portion and a hexagonal threaded cylindrical part vertically located at a lower end, screwed to an upper end of said first cylinder shaft through said hexagonal threaded cylindrical part for being moved up and down along with the movement of said first cylinder shaft;

a stay member with a locating slot fixed on top of said head support;

a pair of adjusting screw bolts symmetrically disposed in said open section of said head support with each upper portion of said adjusting screw bolts vertically extending out of said locating slot for being adjusted to move apart from or closer to each other thereat;

a pair of baffle plates separately screwed to the upper portions of said adjusting screw bolts; and a pair of U-shaped check members, each having a channel formed in a bottom center thereof for being coupled with a horizontal portion of each one of said L-shaped percussion members, screwed to said baffle plates; so that, by resetting said adjusting screw bolts, said L-shaped percussion members can be optionally adjusted to perform staple punching operations.

3. The V-staple driving machine according to claim 1 wherein said pair of staple setting means are composed of a front and a second staple setting devices, each device comprising:

a staple seat having an open trough horizontally formed through a middle portion thereof, an orifice provided in a bottom side, and a pair of sliding slots parallelly located in both upper side walls;

a T-shaped driven piece with its two opposing sides being movably installed in the sliding slots and its front end horizontally extending forward in the open trough of said staple seat;

an open drag frame movably provided along an outer line of the upper side walls of said staple seat by separately fastening each front end of said open drag frame to the opposing sides of said T-shaped driven piece;

a pair of drag springs, each having one end fixed at the opposing sides of said T-shaped driven piece and another end attached to said double positioning seat so as to drag said driven piece to a front end of said staple seat;

an elongated joist with a stub end extending from a bottom side movably disposed in the open trough of said staple seat with the stub end being adjustably inserted in the orifice of said staple seat for being adjusted in conjunction with the different sizes of V-staples to be placed in the open trough of said staple seat;

an upper mold member with a V-shaped front end and a U-shaped opening at a rear portion thereof connected on the front end of said staple seat;

a lower mold member attached to a front bottom side of said staple seat; and an adapter member, having an elongated opening vertically formed on a back side and a pair of grooves separately located in parallel with said elongated opening, screwed to the front end of said staple seat with a staple channel being defined therebetween for receiving respective V-staples and an vertical portion of each L-shaped percussion member in the performance of staple driving operations therewith.

* * * * *